US009403064B2

(12) United States Patent
Molinari

(10) Patent No.: US 9,403,064 B2
(45) Date of Patent: Aug. 2, 2016

(54) GOLF BALL WITH INDICIA PRINTED UNDER TOPCOAT

(75) Inventor: Arthur P. Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 928 days.

(21) Appl. No.: 13/335,570

(22) Filed: Dec. 22, 2011

(65) Prior Publication Data

US 2013/0165269 A1 Jun. 27, 2013

(51) Int. Cl.

| | |
|---|---|
| ***A63B 37/12*** | (2006.01) |
| ***A63B 37/14*** | (2006.01) |
| ***A63B 37/00*** | (2006.01) |
| ***A63B 45/02*** | (2006.01) |
| *A63B 43/00* | (2006.01) |
| *A63B 71/06* | (2006.01) |

(52) U.S. Cl.

CPC ..... *A63B 37/0022* (2013.01); *A63B 37/0003* (2013.01); *A63B 37/0018* (2013.01); *A63B 37/0024* (2013.01); *A63B 37/0051* (2013.01); *A63B 45/02* (2013.01); *A63B 37/0033* (2013.01); *A63B 37/0045* (2013.01); *A63B 37/0064* (2013.01); *A63B 43/008* (2013.01); *A63B 2071/0694* (2013.01)

(58) Field of Classification Search

CPC ..... A63B 37/0022
USPC ..... 473/378, 351
See application file for complete search history.

(56) References Cited

U.S. PATENT DOCUMENTS

| | | | | |
|---|---|---|---|---|
| 4,865,326 | A * | 9/1989 | Isaac et al. | 473/374 |
| 4,998,734 | A | 3/1991 | Meyer | |
| 5,018,742 | A * | 5/1991 | Isaac et al. | 473/378 |
| 5,409,233 | A * | 4/1995 | Kennedy | 473/377 |
| 5,542,680 | A | 8/1996 | Proudfit et al. | |
| 5,580,323 | A * | 12/1996 | Sullivan | 473/371 |
| 5,770,325 | A * | 6/1998 | Keller et al. | 428/187 |
| 5,785,612 | A * | 7/1998 | Shapiro et al. | 473/377 |
| 5,885,173 | A | 3/1999 | Keller | |
| 6,057,043 | A | 5/2000 | Kametani et al. | |
| 6,099,415 | A * | 8/2000 | Lutz | 473/357 |
| 6,120,394 | A * | 9/2000 | Kametani | 473/378 |
| 6,395,861 | B1 * | 5/2002 | Kennedy, III | 528/80 |
| 6,485,377 | B1 * | 11/2002 | Crast et al. | 473/351 |
| 6,509,410 | B2 | 1/2003 | Ohira et al. | |
| 6,540,624 | B1 | 4/2003 | Isogawa | |

(Continued)

OTHER PUBLICATIONS

International Search Report and Written Opinion mailed May 30, 2013 in connection with International Patent Application No. PCT/US2012/070896; 15 pages.

*Primary Examiner* — Gene Kim
*Assistant Examiner* — Matthew B Stanczak
(74) *Attorney, Agent, or Firm* — Honigman Miller Schwartz and Cohn LLP

(57) ABSTRACT

A golf ball is provided that may include one or more structural layers, including an outermost structural layer having an outer surface. The ball may also include a primer coating applied to the entire outer surface of the outermost structural layer. In addition, the ball may include indicia applied on the primer coating in a localized area. Further, the ball may include an intermediate coating applied in the localized area over the indicia, wherein the intermediate coating is formulated to prevent alteration of the indicia by the application of the intermediate coating. A top coating may be applied over the entire ball, including the primer coating and the localized area including the intermediate coating.

7 Claims, 5 Drawing Sheets

(56) References Cited

U.S. PATENT DOCUMENTS

| | | | | |
|---|---|---|---|---|
| 6,544,337 | B1 * | 4/2003 | Skrabski et al. | 118/323 |
| 6,632,877 | B2 * | 10/2003 | Crast et al. | 524/839 |
| 6,736,055 | B2 | 5/2004 | Lutz et al. | |
| 6,893,360 | B2 | 5/2005 | Brown | |
| 7,048,651 | B2 * | 5/2006 | Kennedy et al. | 473/378 |
| 7,247,697 | B2 * | 7/2007 | Hogge et al. | 528/69 |
| 7,448,323 | B2 * | 11/2008 | Kennedy et al. | 101/491 |
| 7,765,931 | B2 | 8/2010 | Kennedy, III et al. | |
| 8,137,753 | B2 * | 3/2012 | Tarao et al. | 427/316 |
| 2002/0151383 | A1 | 10/2002 | Crast et al. | |
| 2003/0121427 | A1 | 7/2003 | Lampinski et al. | |
| 2004/0142765 | A1 * | 7/2004 | Kennedy et al. | 473/351 |
| 2005/0132909 | A1 * | 6/2005 | Lutz | 101/41 |
| 2006/0005718 | A1 | 1/2006 | Ohira | |
| 2006/0196372 | A1 * | 9/2006 | Kennedy et al. | 101/35 |
| 2008/0058122 | A1 | 3/2008 | Kennedy | |
| 2009/0066773 | A1 * | 3/2009 | Kennedy et al. | 347/105 |
| 2010/0091057 | A1 * | 4/2010 | Kennedy et al. | 347/9 |
| 2011/0065530 | A1 | 3/2011 | Molinari et al. | |

* cited by examiner

GOLF BALL WITH INDICIA PRINTED UNDER TOPCOAT

TECHNICAL FIELD

The present invention relates generally to golf balls and, more particularly, to golf balls having indicia printed under a topcoat.

BACKGROUND

It is common for golf balls to include outwardly visible indicia. Such indicia may include, for example, logos, text, stripes, or other types of markings. In some cases, indicia are printed on the outer surface of the ball. However, indicia printed on the outer surface can readily become scuffed and/or removed, for example by contact with a club head and/or impact with the ground. In order to provide a golf ball with more durable indicia, the indicia may be printed under a transparent or substantially transparent top coating (clear coat).

Golf ball top coatings typically include solvents, however, which can smudge ink when applied over indicia. Therefore, in order to provide golf ball indicia with more durability, compromises are typically made in the configuration of the ball. For example, in some cases, primer may be applied to a top-coated ball in a localized area. The localized, primed area may then be printed with indicia, and then covered with a localized top coating. This configuration, however, includes at least three layers of material in a localized area, forming a bulged area, thus resulting in an asymmetric ball in terms of shape and weight. Such asymmetry may negatively affect performance of the ball, as asymmetry may result in altered aerodynamics of the ball, as well as irregular spin.

The present disclosure is directed to improvements in golf balls.

SUMMARY

In one aspect, the present disclosure is directed to a golf ball. The golf ball may include one or more structural layers, including an outermost structural layer having an outer surface. The ball may also include a primer coating applied to the entire outer surface of the outermost structural layer. In addition, the ball may include indicia applied on the primer coating in a localized area. Further, the ball may include an intermediate coating applied in the localized area over the indicia, wherein the intermediate coating is formulated to prevent alteration of the indicia by the application of the intermediate coating. A top coating may be applied over the entire ball, including the primer coating and the localized area including the intermediate coating.

In another aspect, the present disclosure is directed to a method of making golf ball. The method may include forming a ball having one or more structural layers, including an outermost structural layer having an outer surface. In addition, the method may include applying a primer coating to the entire outer surface of the outermost structural layer of the ball. Further, the method may include applying indicia on the primer coating in a localized area. Also, the method may include applying an intermediate coating in the localized area over the indicia, wherein the intermediate coating is formulated to prevent alteration of the indicia by the application of the intermediate coating. The method may also include applying a top coating over the entire ball, including the primer coating and the localized area including the intermediate coating.

In another aspect, the present disclosure is directed to a golf ball. The ball may include one or more structural layers, including an outermost structural layer having an outer surface, a primer coating applied to the entire outer surface of the outermost structural layer, and indicia applied on the primer coating. The ball may also include a top coating applied over the entire ball, including the primer coating and the indicia, wherein at least one of the indicia and the top coating is formulated to prevent alteration of the indicia by the application of the top coating.

In another aspect, the present disclosure is directed to a method of making a golf ball. The method may include forming one or more structural layers, including an outermost structural layer having an outer surface. In addition, the method may include applying a primer coating to the entire outer surface of the outermost structural layer and applying indicia on the primer coating. Further, the method may include applying a top coating over the entire ball, including the primer coating and the indicia, wherein at least one of the indicia and the top coating is formulated to prevent alteration of the indicia by the application of the top coating.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Overview

Figure 1:
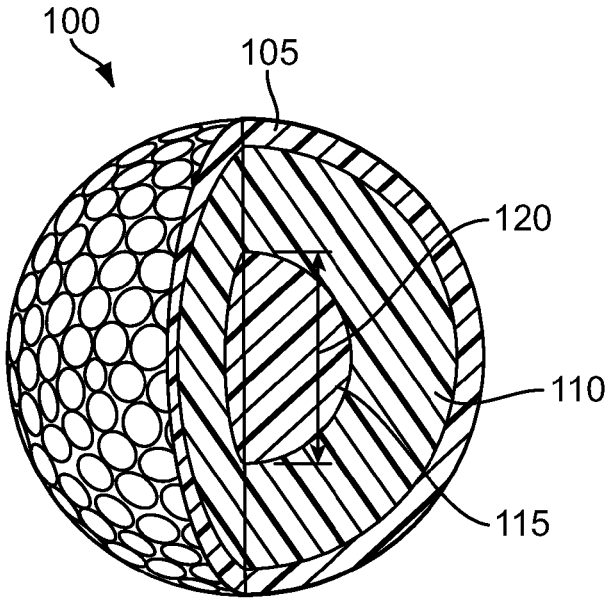
FIG. 1 shows a cutaway, partial cross-sectional view of an exemplary golf ball having a three-piece construction.

The present disclosure relates generally to golf balls having printed indicia. More specifically, the present disclosure relates to golf balls having indicia printed under a top coating.

Golf balls may include one or more layers configured to provide the ball with certain performance characteristics. These layers are structural in nature, and thus, may have a macroscopically observable thickness. For example, such layers may have a thickness measurable in millimeters (or conventional fractions of inches, such as ⅛", ¼", and ½"). In addition, golf balls may include one or more coatings disposed between layers and/or applied to the outermost surface of the outer layer of the golf ball. Such coatings may have a microscopically observable thickness. For example, such coatings may have a thickness measurable in microns/micrometers (or thousandths of inches). Those having ordinary skill in the art will readily recognize the distinction between layers of a golf ball and coatings applied to the layers of a golf ball.

The performance characteristics of a golf ball are determined, at least in part, by the structural configuration of the layers and/or the material compositions of the layers. The overall performance characteristics of the golf ball are affected in certain ways by the makeup of individual layers and also reflect the combination and arrangement of the layers and materials from which the golf ball is formed. In addition, the performance characteristics of a golf ball are also determined, in part, by the configuration of finish coatings. For example, coating layers may provide the golf ball with durability, color and/or design, spin properties, aerodynamics, and other characteristics. Notably, finish coatings can have an affect on aerodynamics, depending on hardness and/or smoothness, as well as dulling of the dimple edges, and other factors.

The concepts discussed in the present disclosure may be applicable to golf balls having any construction, including any suitable number of layers. Further, although the disclosure describes various configurations for golf balls, a person having ordinary skill in the art will be able to adapt the disclosed concepts for implementation in other types of balls (other than golf balls) and other types of layered articles. For example, the disclosed concepts may be applicable to any layered article, such as a projectile, recreational device, or individual components of these articles.

Definitions

For purposes of this disclosure, the terms "compressible," "compressibility," and the like refer to the amount deformation exhibited by an object when compressed under a predetermined set of loading parameters. As used in the present disclosure, compressibility shall refer to compression deformation, which is the deformation amount (in millimeters) of an object when compressed by a force, specifically, the deformation of the object when the compression force is increased from 10 kg to 130 kg. The deformation amount of the object under the force of 10 kg is subtracted from the deformation amount of the object under the force of 130 kg to obtain the compression deformation value of the object. While compressibility (and compression deformation) is a parameter that may be measured for entire golf balls, compressibility can also be measured for individual components of golf balls. In the present disclosure, compressibility of a golf ball groove material is measured and discussed in detail.

Hardness of a golf ball layer is measured generally in accordance with ASTM D-2240. In some cases the hardness may be measured on a cross-sectional surface of a ball layer. In other cases, the hardness may be measured on the curved surface of a ball layer.

Golf Ball Structure Generally

Figure 2:
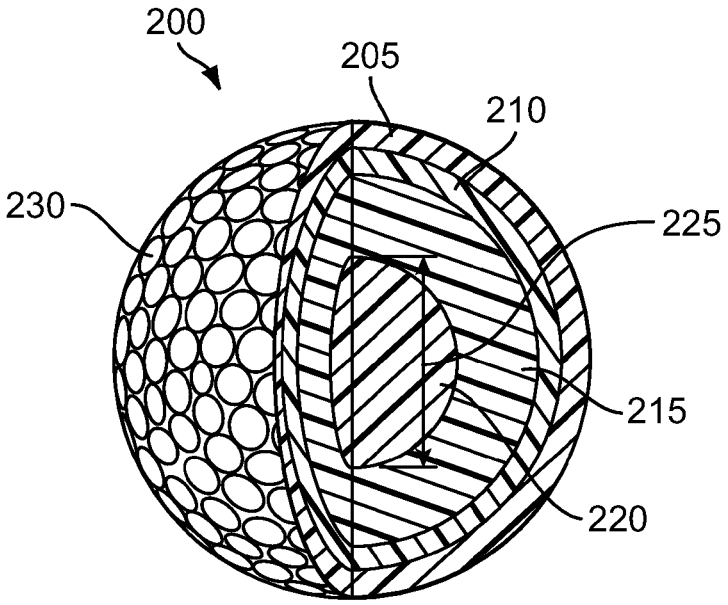
FIG. 2 shows a cutaway, partial cross-sectional view of an exemplary golf ball having a four-piece construction.

The disclosed concepts may be applicable to golf balls having any internal structural configuration. FIGS. 1 and 2 illustrate exemplary 3-layer and 4-layer golf ball constructions, respectively.

3-Layer Ball Structure

FIG. 1 illustrates a cutaway, partial cross-sectional view of an exemplary three-layer golf ball construction. As shown in FIG. 1, a golf ball 100 may include a cover layer 105, an outer core layer 110 disposed radially inward of cover layer 105, and an inner core layer 115 disposed radially inward of outer core layer 110. The dimensions and materials of each layer may be selected to achieve desired performance characteristics.

Cover layer 105 may be formed of a relatively soft but durable material. For example, cover layer 105 may be formed of a material that compresses/flexes when struck by a golf club, in order to provide spin of the ball and feel to the player. Although relatively soft, the material may also be durable, in order to withstand scuffing from the club and/or the golf course. Exemplary cover layer materials may include urethane or ionomer blends, and/or any other suitable material.

In addition, FIG. 1 illustrates the outer surface of cover layer 105 as having a generic dimple pattern. While the dimple pattern on golf ball 100 may affect the flight path of golf ball 100, any suitable dimple pattern may be used with the disclosed embodiments. In some embodiments, golf ball 100 may be provided with a dimple pattern including a total number of dimples between approximately 300 and 400.

Outer core layer 110 may be formed of a relatively firm and suitably resilient material. Outer core layer 110 may be configured to provide a relatively high launch angle and a relatively low spin rate when the ball is struck by a driver, and a relatively higher spin rate and increased control when struck with irons. This may provide distance off the tee with spin and control around the greens. Inner core layer 115 may be formed of a relatively firm material in order to provide distance.

The thickness of the golf ball layers may be varied in order to achieve desired performance characteristics. In some embodiments, inner core layer 115 may have a diameter in the range of about 19 mm to 30 mm. For example, in some embodiments, inner core layer 115 may be spherical with a diameter 120 of approximately 24 mm to 28 mm.

4-Layer Ball Structure

FIG. 2 is a cutaway, partial cross-sectional view of a golf ball 200 having a four-piece construction. As shown in FIG. 2, golf ball 200 may have four layers that are positioned adjacent one another. For example, in some embodiments, golf ball 200 may include an outer cover layer 205 and an inner cover layer 210 disposed radially inward of outer cover layer 205. Golf ball 200 may also include an outer core layer 215 disposed radially inward of inner cover layer 210, and an inner core layer 220 disposed radially inward of outer core layer 215. Any layer may surround or substantially surround any layers disposed radially inward of that layer. For example, outer core layer 215 may surround or substantially surround inner core layer 220.

As shown in FIG. 2, golf ball 200 may dimples 230 which may be formed in outer cover layer 205. As noted above, dimples 230 may have any suitable configuration.

In the present disclosure and drawings, golf ball 200 is described and illustrated as having four layers. In some embodiments, at least one additional layer may be added. For example, in some embodiments, a mantle layer may be added between outer core layer 215 and inner cover layer 210. In some embodiments, an intermediate cover layer may be inserted between inner cover layer 210 and outer cover layer 205. Further, in some embodiments, an intermediate core layer may be inserted between inner core layer 220 and outer core layer 215. Other layers may be added on either side of any disclosed layer as desired to achieve certain performance characteristics and/or attributes.

In some embodiments, golf ball 200 may have a diameter of at least 42.67 mm (1.680 inches), in accordance with the Rules of Golf. For example, in some embodiments, golf ball 200 may have a ball diameter between about 42.67 mm and about 42.9 mm, and may, in some embodiments, have a ball diameter of about 42.7 mm. Golf ball 200 may have a ball weight between about 45 g and about 45.8 g and may, in some embodiments, have a ball weight of about 45.4 g.

The thickness of the layers of golf ball 200 may be varied in order to achieve desired performance characteristics. In some embodiments, outer cover layer 205 may have a thickness of approximately 0.5 mm to 2 mm. In addition, in some embodiments, inner cover layer 210 may have a thickness of approximately 0.5 mm to 2 mm. In some embodiments, outer cover layer 205 and/or inner cover layer 210 may have a thickness of approximately 0.8 mm to 2 mm. In some embodiments, outer cover layer 205 and/or inner cover layer 210 may have a thickness of approximately 1 mm to 1.5 mm.

In some embodiments, outer core layer 215 may have a thickness of at least about 5 mm. In some embodiments, inner core layer 220 may be a sphere having a diameter 225 in the range of approximately 21 mm to 30 mm. In some embodiments, diameter 225 of inner core layer 220 may be in the range of approximately 24 mm to 28 mm. For example, in some embodiments, diameter 225 may be 24 mm. In other embodiments, diameter 225 may be 28 mm.

In some embodiments, the inner core layer may be formed by any suitable process, such as injection molding or compression molding. Further the inner core layer may be formed of any suitable material. In some embodiments, the inner core layer may be formed of a rubber material. In some embodiments, the inner core layer may be hollow. Further, in some embodiments, the inner core layer may have a hollow, liquid-filled structure.

In some embodiments, the inner core layer may be formed, for example, of a thermoplastic material. In some embodiments, suitable thermoplastic materials may include, for example, an ionomer resin, such as Surlyn, produced by E. I. Dupont de Nemous and Company. In some embodiments, the inner core layer may be formed from a highly neutralized acid polymer composition. Exemplary highly neutralized acid polymer compositions suitable for forming the inner core layer may include, for example, HPF resins such as HPF1000, HPF2000, HPF AD1024, HPF AD1027, HPF AD1030, HPF AD1035, HPF AD1040, all produced by E. I. Dupont de Nemous and Company.

The acid polymer may be neutralized to 80% or higher, including up to 100%, with a suitable cation source, such as magnesium, sodium, zinc, or potassium. Suitable highly neutralized acid polymer compositions for use in forming the inner core layer may include a highly neutralized acid polymer composition and optionally additives, fillers, and/or melt flow modifiers.

Suitable additives and fillers may include, for example, blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, acid copolymer wax, surfactants. In some embodiments, the additives and fillers may include, for example, inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and other types of organic fillers. In some embodiments, the additives and fillers may include, for example, high specific gravity metal powder fillers, such as tungsten powder, molybdenum powder, and others. In some embodiments the additives and fillers may include regrind, that is, core material that is ground and recycled.

Any suitable melt flow modifiers may be included in the highly neutralized acid polymer composition. Exemplary suitable melt flow modifiers may include, for example, fatty acids and salts thereof, polyamides, polyesters, polyacrylates, polyurethanes, polyethers, polyureas, polyhydric alcohols, and combinations thereof.

The outer core layer may be formed by any suitable method, such as compression molding. Further, the outer core layer may be formed of any suitable material, such as a thermoset material. For example, in some embodiments, outer core layer 215 may be formed by crosslinking a polybutadiene rubber composition. When other rubber is used in combination with a polybutadiene, polybutadiene may be included as a principal component. For example, a proportion of polybutadiene in the entire base rubber may be equal to or greater than 50% by weight and, in some embodiments, may be equal to or greater than 80% by weight. In some embodiments, outer core layer 215 may be formed of a polybutadiene rubber composition including a polybutadiene having a proportion of cis-1,4 bonds of equal to or greater than 60 mol %. For example, in some embodiments, the proportion may be equal to or greater than 80 mol %.

In some embodiments, cis-1,4-polybutadiene may be used as the base rubber and mixed with other ingredients. In some embodiments, the amount of cis-1,4-polybutadiene may be at least 50 parts by weight, based on 100 parts by weight of the rubber compound. Various additives may be added to the base rubber to form a compound. The additives may include a cross-linking agent and a filler. In some embodiments, the cross-linking agent may be zinc diacrylate, magnesium acrylate, zinc methacrylate, or magnesium methacrylate. In some embodiments, zinc diacrylate may provide advantageous resilience properties.

In some embodiments, the filler may include zinc oxide, barium sulfate, calcium carbonate, or magnesium carbonate. In some embodiments, zinc oxide may be selected for its advantageous properties. In some embodiments, the filler may be used to increase the specific gravity of the material. For example, metal powder, such as tungsten, may alternatively be used as a filler to achieve a desired specific gravity. In some embodiments, the specific gravity of outer core layer 215 may be in the range of about 1.05 g/cm^3 to about 1.35 g/cm^3.

In some embodiments, a polybutadiene synthesized using a rare earth element catalyst is preferred. Using this polybutadiene may provide golf ball 200 with increased resilience. Examples of rare earth element catalysts include lanthanum series rare earth element compound, organoaluminum compound, and almoxane and halogen containing compound. A lanthanum series rare earth element compound is preferred. Polybutadiene obtained by using lanthanum rare earth-based catalysts usually employ a combination of a lanthanum rare earth (atomic number of 57 to 71) compound, but particularly preferred is a neodymium compound.

In some embodiments, the polybutadiene rubber composition may comprise at least from about 0.5 parts by weight to about 5 parts by weight of a halogenated organosulfur compound. In some embodiments, the polybutadiene rubber composition may comprise at least from about 1 part by weight to about 4 parts by weight of a halogenated organosulfur compound. The halogenated organosulfur compound may be selected from the group consisting of pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol; pentabromothiophenol; 2-bromothiophenol; 3-bromothiophenol 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; and their zinc salts, the metal salts thereof and mixtures thereof.

One or more cover layers may be molded to enclose the outer core layer. The cover layers may be formed of any suitable materials. For example, in some embodiments, cover layers may be formed from thermoplastic or thermoset materials. In some embodiments, inner cover layer 210 and/or outer cover layer 205 may be made from a thermoplastic material including at least one of an ionomer resin, a highly neutralized acid polymer composition, a polyamide resin, a polyester resin, and a polyurethane resin. In some embodiments, an ionomer resin, polyurethane resin, or highly neutralized acid polymer composition may be more preferred for inner cover layer 210 or outer cover layer 205. In some embodiments, inner cover layer 210 may be formed of the same type of material as outer cover layer 205. In other embodiments, inner cover layer 210 may be formed of a different type of material from outer cover layer 205.

The disclosed concepts may be implemented in golf balls having three-layer construction, four-layer construction, five-layer construction, or any other suitable configuration. Exemplary such concepts are discussed below.

Indicia and Coatings

The outer surface layer of a golf ball typically experiences significant amounts of abuse from contact with golf club heads and from impact with the ground. It may also be desirable for the outer surface layer to be visually appealing. For these reasons, golf balls often include a top coating that forms the outermost surface layer. This top coating may be durable, and may also provide visual appeal due to its finish. For example, in some embodiments, top coatings may have a shiny or glossy finish. In some embodiments, top coatings may include optical brighteners and/or shiny particles. In addition, golf balls may include additional visual features, such as indicia. Such indicia may include colors, graphics, logos, geometrical shapes, lettering, and other types of markings.

One or more finish coatings, including paint or other colorations, as well as one or more topcoats or clearcoats may be applied to an outer surface of the disclosed layers. These finish coatings may have relatively insignificant thickness in comparison to the thickness of the disclosed layers. Thus, the present disclosure shall use the term "coating" when referring to a very thin application of material (e.g., on the order of thousandths of an inch thick), and will use the term "layer" when referring to a thicker portion of material (e.g., on the order of millimeters in thickness).

In some embodiments, a golf ball may include features to provide the indicia with durability. For example, in some embodiments, the indicia may be printed on a primer layer and the ball may be finished with one or more top coatings. In order to allow the indicia to be visible through the top coatings, the top coatings may permit some level of light transmission. For example, in some embodiments, the top coatings may be transparent or substantially transparent. A transparent coating allows light to pass through the coating, thus permitting underlying indicia to be viewed relatively clearly through the top coating. In other embodiments, the top coatings may be translucent. A translucent coating allows light to pass through diffusely (i.e., with light scattering), permitting a less crisp view of underlying indicia, which may thus appear through the coating as blurred, fuzzy, or partially obscured.

Top coatings that are typically used on golf balls include solvents in which the indicia ink may be soluble. Therefore, application of solvent-based top coatings to such printed indicia may alter the indicia, for example, by smudging, smearing, or otherwise removing the indicia ink. Accordingly, in some disclosed embodiments, an ink that is not soluble in top coating solvents may be utilized. In other embodiments, a top coating that does not include solvents may be utilized. For example, in some embodiments, a waterborne top coating may be used. In still other embodiments, indicia may be printed on a primer layer and a localized transparent, substantially transparent, or translucent intermediate coating may be applied over the indicia, wherein the localized intermediate coating does not include solvents. Then any suitable transparent, substantially transparent, or translucent top coating may be applied over the primer coating and the intermediate coating. This will prevent solvents in the top coating from altering the indicia by dissolving or partially dissolving the indicia ink.

Non-Smudging Intermediate Layer

Figure 3:
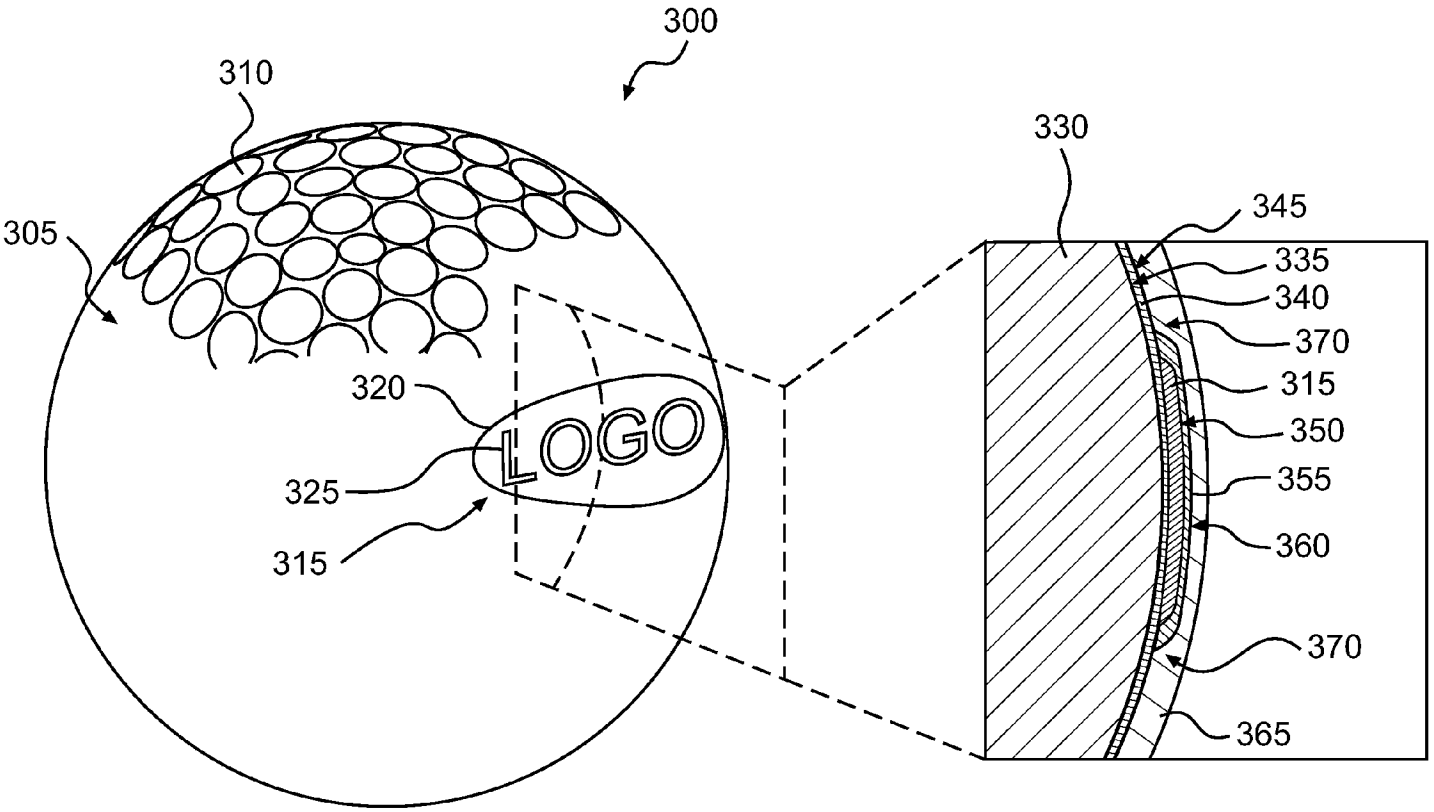
FIG. 3 shows elevation and partial cross-sectional views of an exemplary golf ball having indicia disposed under an intermediate coating.

FIG. 3 illustrates an exemplary golf ball 300 having an outer surface 305. Outer surface 305 of golf ball 300 may include any suitable surface features. For example, in some embodiments, ball 300 may include aerodynamic features, such as dimples 310. Dimples 310 may be provided in any suitable pattern. Those having ordinary skill in the art will recognize suitable dimple arrangements, as well as suitable configurations of other possible surface features.

As shown in FIG. 3, ball 300 may include indicia 315. In some embodiments, indicia 315 may be a printed ink. For example, in some embodiments, indicia 315 may be applied by inkjet printing. Indicia 315 may have any suitable form. For example, in some embodiments, indicia 315 may include one or more geometrical shapes 320, as shown in FIG. 3. Alternatively, or additionally, indicia 315 may include text 325. Indicia 315 may be provided in the form of a logo, graphic, image, lettering, or any other suitable form.

Ball 300 may have one or more structural layers. For example, ball 300 may include at least one core layer and at least one cover layer disposed radially outward of the at least one core layer. The cover layer may be the outermost structural layer 330 of ball 300. As shown in FIG. 3, outermost structural layer 330 may include an outer surface 335. Outermost structural layer 330 may have properties similar to cover layer 105 and/or outer cover layer 205 discussed above.

Finish coatings may be applied to outer surface 335 of outermost structural layer 330. In some embodiments, the finish coatings may incorporate indicia that is arranged with the finish coatings in a manner that ensures the indicia is not altered by solvents in one or more of the finish coatings, and is protected from abrasion and other types of damage that may result from contact of the outer surface of the ball with the club face and with the ground during play as well as non-play handling of the ball.

FIG. 3 illustrates an exemplary embodiment, in which an intermediate coating is applied in a localized area to cover and isolate the indicia from a traditional top coating that is applied to the entire surface of the ball. As shown in FIG. 3, ball 300 may include a primer coating 340. In some embodiments, primer coating 340 may be applied to the entire outer surface 335 of outermost structural layer 330. In some embodiments, indicia 315 may be applied to an outer surface 345 of primer coating 340 in a localized area, as shown in FIG. 3. Indicia 315 may be applied on outer surface 345 of primer coating 340. Indicia 315 may include an outer surface 350 and, in some embodiments, ball 300 may include an intermediate coating 355 applied in the localized area, to outer surface 350 of indicia 315. Intermediate coating 355 may also include an outer surface 360, and ball 300 may include at least one top coating 365 applied to the entire ball, including primer coating 340 and the localized area including intermediate coating 335. In some embodiments, top coating 365 may be the outermost coating of ball 300.

Primer coating 340 may have any suitable formulation. Primer coating 340 may be provided to facilitate adhesion between outermost structural layer 330 and top coating 365. That is, in some cases, the materials used for outermost structural layer 330 and top coating 365 may not adhere well to one another. For example, in some embodiments, outermost structural layer 330 may be formed of Surlyn and top coating 365 may be urethane-based. In some configurations, urethane-based coatings may not adhere to Surlyn layers as well as desired. In such configurations, a primer layer may be utilized between outermost structural layer 330 and top coating 365.

Similarly, in some embodiments, primer coating 340 may facilitate adhesion between outermost structural layer 330 and indicia 315. Thus, a primer coating may be included in order to prevent smearing of indicia 315 applied to outermost structural layer 330. Accordingly, use of primer coating 340 may be advantageous even in embodiments in which both outermost structural layer 330 and top coating 365 are urethane-based, and thus adhere to one another as desired.

Further, in some embodiments, primer coating 340 may include one or more dyes and/or pigments. In some embodiments, primer coating 340 may provide the visible color for a substantial majority of ball 300. For example, primer coating 340 may have a white color as is commonly found on traditional golf balls, and other colors may also be possible. Therefore, in some embodiments, primer coating 340 may have a paint-type formulation. Further, as primer coating 340 may provide the outwardly visible coloration of ball 300, in some embodiments, primer coating 340 may be substantially opaque.

Top coating 365 may have any suitable formulation. In some embodiments, top coating 365 may be a nonaqueous solvent-based coating. That is, the material of top coating 365 may include one or more nonaqueous solvents (i.e., solvents other than water) prior to application. For example, in some embodiments, top coating 365 may include urethane or polyurethane, which is, prior to application of top coating 365, dissolved in a non-aqueous solvent, such as, polyester or polyether.

Indicia 315 may have any suitable form. In some embodiments, indicia 315 may include an ink. Exemplary inks may include a variety of components including, for example, pigments and/or dyes, solvents, resins, lubricants, solubilizers, surfactants, particulate matter, fluorescers, and other materials. Suitable inks may have a liquid, paste, or powder form. In some embodiments, the ink may be aqueous. In other embodiments, non-aqueous solvent-based inks may be utilized. In some embodiments, inks or other indicia materials may be cured after application to the golf ball. For instance, in some embodiments, an indicia ink may be cured, for example, using ultraviolet (UV) light. Those having ordinary skill in the art will recognize various suitable formulations for inks and other indicia materials for use in golf balls.

In some embodiments, indicia 315 may include an inkjet printing ink. Thus, in some embodiments, indicia 315 may be applied on primer coating 340 with an inkjet printing machine. In some embodiments, at least some of indicia 315 may be applied using another printing method or another suitable process. Suitable indicia inks (or other indicia materials that include, for example, pigments, dyes, or other coloring agents) may, in some embodiments, be soluble in at least one nonaqueous solvent on which top coating 365 is based. Further, in some embodiments, indicia 315 may include ink that is insoluble in water.

In order to prevent indicia 315 from becoming smudged, smeared, or otherwise altered during manufacturing of ball 300, indicia 315 may be isolated from top coating 365 (and its solvents) by intermediate coating 355. Intermediate coating 355 may be formulated to prevent alteration of indicia 315 by the application of intermediate coating 355. For example, in some embodiments, intermediate coating 355 may be a waterborne coating. In such embodiments, indicia 315 may include ink that is insoluble in water.

As shown in FIG. 3, intermediate coating 355 may completely cover the entirety of indicia 315. For example, as shown in FIG. 3, the boundary region 370 of indicia 315 may be covered by intermediate coating 355. Accordingly, indicia 315 may be completely encapsulated by primer coating 340 and intermediate coating 355, thus isolating indicia 315 from top coating 365.

It should be noted that although exemplary embodiments have been discussed above in which the indicia ink may be water insoluble and soluble in nonaqueous solvents, embodiments are possible in which the indicia ink may have opposite properties. That is, in some embodiments, the indicia ink may be water soluble and insoluble in nonaqueous solvents. In such embodiments, the intermediate coating may be nonaqueous solvent-based and the top coating may be waterborne.

Figure 4:
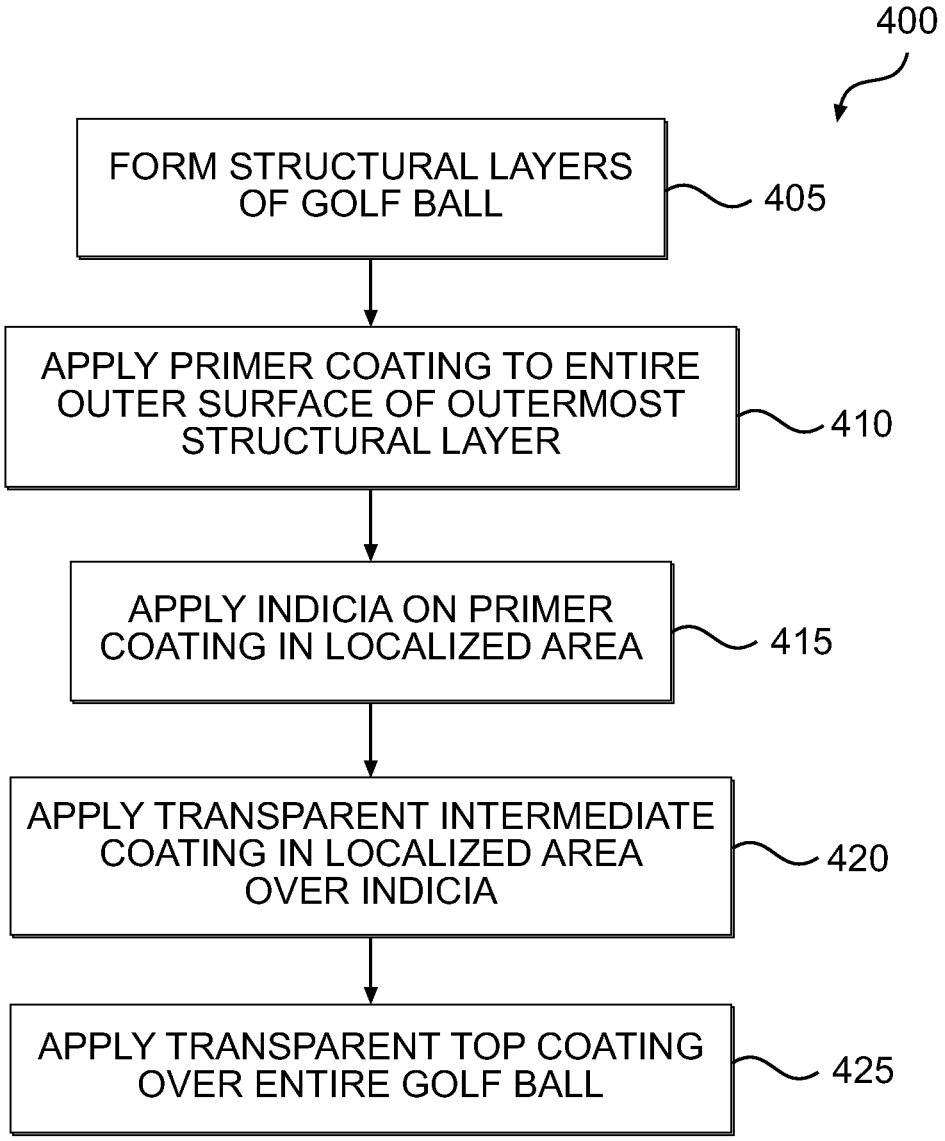
FIG. 4 shows an exemplary method of making a golf ball according to the embodiment shown in FIG. 3.

FIG. 4 illustrates an exemplary method 400 for making a golf ball according to the concepts discussed above. As shown in FIG. 4, such a method 400 may include forming a ball having one or more structural layers, including an outermost structural layer having an outer surface (step 405). In addition, the method may include applying a primer coating to the entire outer surface of the outermost structural layer of the ball (step 410). Further, the method may include applying indicia on the primer coating in a localized area (step 415). Also, the method may include applying an intermediate coating in the localized area over the indicia (step 420). As discussed above, the intermediate coating may be formulated to prevent alteration of the indicia by the application of the intermediate coating. The method may also include applying a top coating over the entire ball, including the primer coating and the localized area including the intermediate coating (step 425). In some embodiments the top coating may be the outermost coating of the golf ball.

The materials and components involved in the implementation of method 400 may have properties consistent with the embodiments discussed above. For example, in some embodiments, applying the indicia to the primer coating may include printing an ink onto the primer coating. Printing the ink may include inkjet printing. In some embodiments, the intermediate coating may be a waterborne coating and the top coating may include one or more nonaqueous solvents. Further, applying the indicia may include printing the indicia with an ink that is soluble in at least one of the one or more nonaqueous solvents in the top coating.

The configuration discussed above may be advantageous because indicia materials (e.g., inks) that are soluble in nonaqueous solvents may be desirable for golf ball printing due to performance characteristics and/or expense. Further, it may be beneficial to use top coatings that are nonaqueous solvent-based, for similar reasons.

Smudge-Free Ink/Top Coating

As an alternative to using a localized intermediate coating, alteration of the indicia during manufacturing may be prevented by using indicia material that does not smudge due to the application of a top coating having nonaqueous solvents. For example, in some embodiments, the indicia ink may be insoluble in such nonaqueous solvents. Further, in some alternative embodiments, the top coating may be formulated to prevent alteration of the indicia upon applying the top coating. For example, the top coating may be a waterborne coating. With a waterborne top coating, an indicia material that is soluble in nonaqueous solvents may be utilized. As discussed above, this may be advantageous because indicia materials (e.g., inks) that are soluble in nonaqueous solvents may be desirable for golf ball printing due to performance characteristics and/or expense. Further, it may be beneficial to use top coatings that are nonaqueous solvent-based, for similar reasons.

Figure 5:
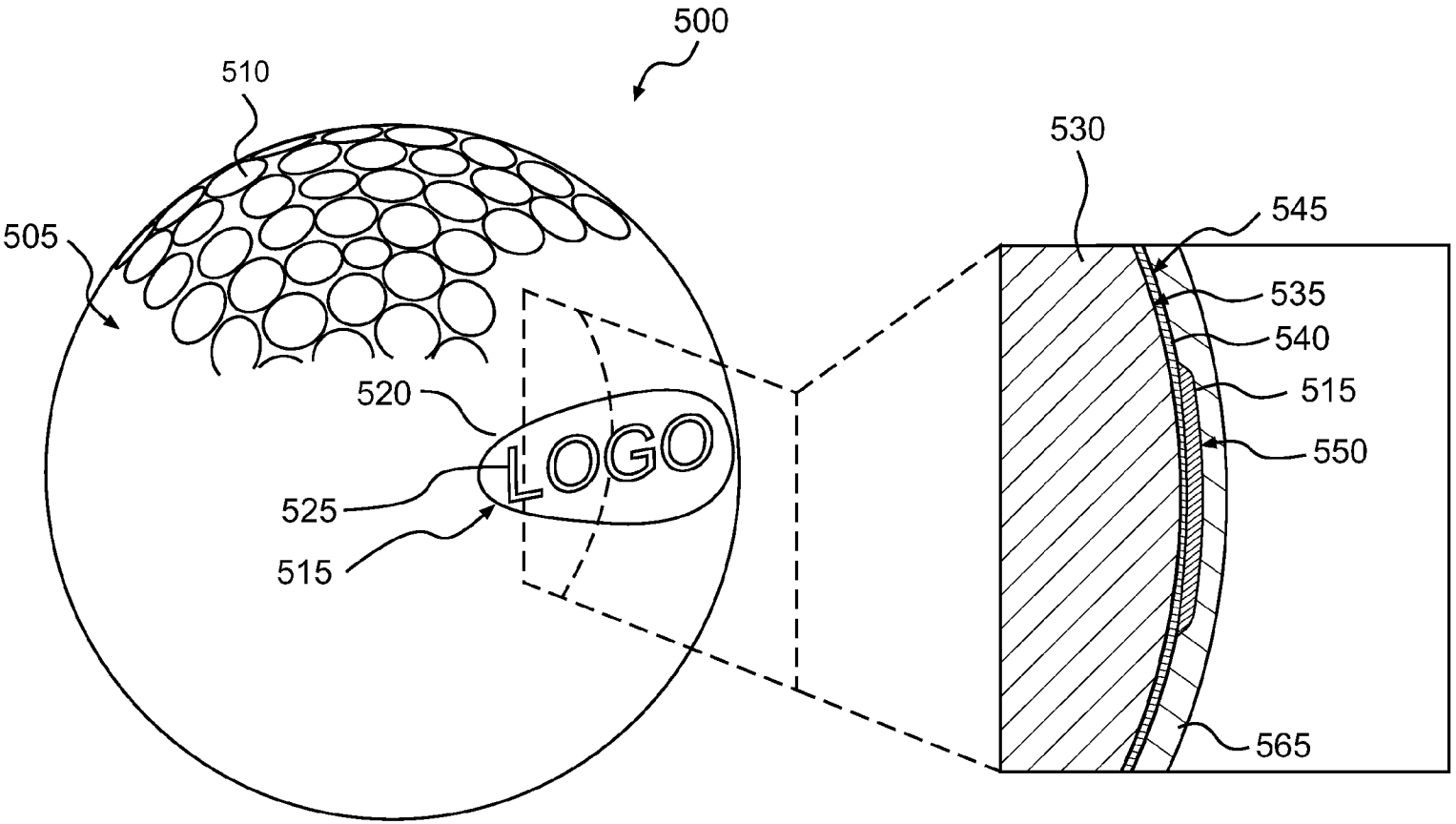
FIG. 5 shows elevation and partial cross-sectional views of an exemplary golf ball having indicia disposed between a primer coating and a top coating.

FIG. 5 illustrates an exemplary golf ball 500 having an outer surface 505. Outer surface 505 of golf ball 500 may include any suitable surface features. For example, in some embodiments, ball 500 may include aerodynamic features, such as dimples 510. Dimples 510 may be provided in any suitable pattern. Those having ordinary skill in the art will recognize suitable dimple arrangements, as well configurations of other suitable surface features.

As shown in FIG. 5, ball 500 may include indicia 515. In some embodiments, indicia 515 may be a printed ink. For example, in some embodiments, indicia 515 may be applied by inkjet printing. Indicia 515 may have any suitable form. For example, in some embodiments, indicia 515 may include one or more geometrical shapes 520, as shown in FIG. 5. Alternatively, or additionally, indicia 515 may include text 525. Indicia 515 may be provided in the form of a logo, graphic, image, lettering, or any other suitable form.

Ball 500 may have one or more structural layers. For example, ball 500 may include at least one core layer and at least one cover layer disposed radially outward of the at least one core layer. The cover layer may be the outermost structural layer 530 of ball 500. As shown in FIG. 5, outermost structural layer 530 may include an outer surface 535. Outermost structural layer 530 may have properties similar to cover layer 105 and/or outer cover layer 205 discussed above.

Finish coatings may be applied to outer surface 535 of outermost structural layer 530. In some embodiments, the finish coatings may incorporate indicia that is arranged with the finish coatings in a manner that ensures the indicia is not altered by solvents in one or more of the finish coatings, and is protected from abrasion and other types of damage that may result from contact of the outer surface of the ball with the club face and with the ground during play as well as non-play handling of the ball.

As shown in FIG. 5, ball 500 may include a primer coating 540. In some embodiments, primer coating 540 may be applied to the entire outer surface 535 of outermost structural layer 530. In some embodiments, indicia 515 may be applied to an outer surface 545 of primer coating 540 in a localized area, as shown in FIG. 5. Indicia 515 may be applied on outer surface 545 of primer coating 540. Indicia 515 may include an outer surface, and ball 500 may include at least one top coating 565 applied to the entire ball, including primer coating 540 and the localized area including intermediate coating 535. In some embodiments, top coating 565 may be the outermost coating of ball 500.

Primer coating 540 may have any suitable formulation. In some embodiments, primer coating 540 may include one or more dyes and/or pigments. In some embodiments, primer coating 540 may provide the visible color for a substantial majority of ball 500. For example, primer coating 540 may have a white color as is commonly found on traditional golf balls, and other colors may also be possible. Therefore, in some embodiments, primer coating 540 may have a paint-type formulation. Further, as primer coating 540 may provide the outwardly visible coloration of ball 500, in some embodiments, primer coating 540 may be substantially opaque.

In some embodiments, at least one of indicia 515 and top coating 565 may be formulated to prevent alteration of indicia 515 by the application of top coating 565. Similar concepts to those discussed may apply to the compatibility of indicia 515 and top coating 565. For example, in some embodiments, top coating 565 may be a waterborne coating, and indicia 515 may include an ink that is insoluble in water. In other embodiments, top coating 565 may be a nonaqueous solvent-based coating. In such embodiments, indicia 515 may include an ink that is insoluble in one or more of the nonaqueous solvents on which top coating 565 is based. As discussed above regarding indicia 315, indicia 515 may be formed from an inkjet printing ink.

Figure 6:
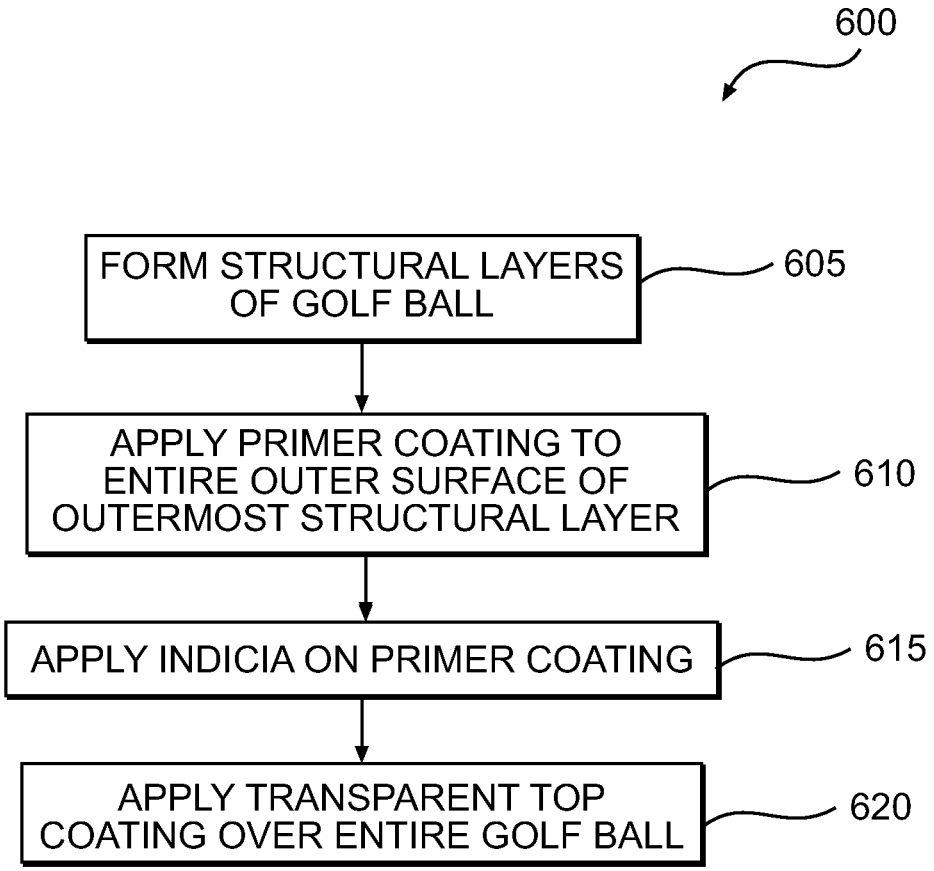
FIG. 6 shows an exemplary method of making a golf ball according to the embodiment shown in FIG. 5.

FIG. 6 illustrates an exemplary method 600 for making a golf ball according to the concepts discussed above with regard to the embodiment shown in FIG. 5. As shown in FIG. 6, such a method 600 may include forming one or more structural layers, including an outermost structural layer having an outer surface (step 605). In addition, the method may include applying a primer coating to the entire outer surface of the outermost structural layer of the ball (step 610). Further, the method may include applying indicia on the primer coating (step 615). Also, the method may include applying a top coating over the entire ball, including the primer coating and the indicia (step 620). As discussed above, at least one of the indicia and the top coating may be formulated to prevent alteration of the indicia by the application of the top coating. In some embodiments the top coating may be the outermost coating of the golf ball.

The materials and components involved in the implementation of method 600 may have properties consistent with the embodiments discussed above. For example, in some embodiments, applying the indicia to the primer coating may include printing an ink onto the primer coating. Printing the ink may include inkjet printing. In some embodiments, the top coating may be a waterborne coating and the indicia may include an ink that is insoluble in water. In other embodiments, the top coating may include one or more nonaqueous solvents, and the indicia may include an ink that is insoluble in at least one of the one or more nonaqueous solvents included in the top coating.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Features of any embodiment described in the present disclosure may be included in any other embodiment described in the present disclosure. Also, various modifications and changes may be made within the scope of the attached claims.

What is claimed is:

1. A golf ball, comprising:

one or more structural layers, including an outermost structural layer having an outer surface;

a primer coating that is opaque and provides visible color applied to the entire outer surface of the outermost structural layer;

indicia applied as an ink insoluble in water on the primer coating;

an intermediate coating applied only on a localized area over and around the indicia, wherein the intermediate coating is formulated to prevent alteration of the indicia by the application of the intermediate coating and wherein the intermediate coating is applied as a waterborne coating; and a transparent top coating applied over the entire ball, wherein the top coating is applied as a nonaqueous solvent-based coating, wherein the ink is soluble in at least one nonaqueous solvent in the top coating, wherein the intermediate coating prevents alteration of the indicia by the at least one nonaqueous solvent in the top coating.

2. The golf ball of claim 1, wherein the ink is an inkjet printing ink.

3. The golf ball of claim 1, wherein the indicia is applied as an ink that is soluble in at least one nonaqueous solvent in a top coating composition used to apply the top coating.

4. The golf ball of claim 1, wherein the top coating is the outermost coating of the golf ball.

5. A method of making golf ball, comprising:

forming a ball having one or more structural layers, including an outermost structural layer having an outer surface;

applying a primer coating that is opaque and provides visible color to the entire outer surface of the outermost structural layer of the ball;

printing indicia with an ink insoluble in water on the primer coating;

applying a waterborne intermediate coating only to a localized area over and around the indicia, wherein the intermediate coating is formulated to prevent alteration of the indicia by the application of the intermediate coating; and applying a transparent top coating over the entire ball, wherein the top coating is applied as a nonaqueous solvent-based coating and the ink is soluble in at least one nonaqueous solvent in the top coating, wherein the intermediate coating prevents alteration of the indicia by the at least one nonaqueous solvent in the top coating.

6. The method of claim 5, wherein printing the ink includes inkjet printing.

7. The method of claim 5, wherein the top coating is the outermost coating of the golf ball.

* * * * *